US005564707A

United States Patent [19]

Dinh

[11] Patent Number: 5,564,707

[45] Date of Patent: Oct. 15, 1996

[54] GOLF BALL INCLUDING ALIGNMENT MARKINGS

[76] Inventor: Vincent P. Dinh, 745 Overture Ct., San Jose, Calif. 95134

[21] Appl. No.: 535,567

[22] Filed: Sep. 28, 1995

[51] Int. Cl.[6] ..... A63B 69/36

[52] U.S. Cl. ..... 473/218; 473/268; 473/270; 473/280; 473/353; 40/327

[58] Field of Search ..... 273/187.3, 213; 473/218, 266, 268, 270, 280, 351, 353, 378, 407; 40/327

[56] References Cited

U.S. PATENT DOCUMENTS

| | | | |
|---|---|---|---|
| 676,506 | 6/1901 | Knight et al. | 273/187.3 X |
| 3,325,168 | 6/1967 | Fyanes | 273/187.3 |
| 3,420,529 | 1/1969 | Goranson et al. | 273/213 |
| 3,753,565 | 8/1973 | Baker | 273/213 |
| 4,209,172 | 6/1980 | Yamamoto | 273/183 C |
| 4,441,716 | 4/1984 | Chen | 273/187.3 |
| 5,067,719 | 11/1991 | Mook | 273/213 |

FOREIGN PATENT DOCUMENTS

| | | | |
|---|---|---|---|
| 11171 | of 1904 | United Kingdom | 273/213 |

*Primary Examiner*—George J. Marlo
*Attorney, Agent, or Firm*—Terry McHugh

[57] ABSTRACT

A golf ball and method include providing a number of indicators for properly aligning a golf ball, a golfer and a golf club relative to an intended path of travel. The indicators include a ball-travel indicator for alignment with the intended path, a ball-to-ground indicator for positioning the golf ball in relation to the surface on which the ball is positioned, a foot-to-ball indicator for aligning the golfer, and a putter-alignment indicator for properly positioning a striking face of the golf club. In the preferred embodiment, the indicators are stenciled onto the golf ball.

6 Claims, 2 Drawing Sheets

GOLF BALL INCLUDING ALIGNMENT MARKINGS

TECHNICAL FIELD

The invention relates generally to golfing and more particularly to golf balls.

BACKGROUND ART

A properly executed putt by a golfer involves a number of alignment subtleties. There are three elements to a putt. Firstly, determinations must be made regarding the speed and direction of the ball following impact by a golf putter. Many greens include slopes that will cause a ball to "break" as it travels from the point of impact to a hole. Consequently, the determinations of speed and direction must involve "reading" the green. The second element is one of positioning the golfer relative to the desired direction of ball travel. The final element involves stroking the golf ball with the putter in a manner that achieves the desired initial direction and the desired initial speed.

While there are various styles of putting among golfers, it is generally accepted that a fundamentally correct execution of a putt requires the golfer's feet to be perpendicular to the desired path of the ball, with the face of the putter being held so that it is parallel to the golfer's feet and, therefore, perpendicular to the desired path of ball travel. Consequently, even if a green is accurately "read," the putt will be missed if the golfer is "aimed" improperly. As an example, for a right-handed golfer on a flat green, if the golfer is mistakenly positioned so that the heel of a properly gripped putter is closer to the golf hole than the toe of the putter, the ball will travel to the right of the golf hole.

It is known to include alignment lines on either or both of the ball and the putter to facilitate putting. U.S. Pat. No. 4,209,172 to Yamamoto teaches a golf ball and a putting club, which each include alignment lines. The ball includes equatorial markings that are at right angles to each other. The putting club includes a first line that is perpendicular to the striking face of the club and second line that is parallel to the striking face. In use, the ball is positioned so that one of the equatorial markings will roll along the target direction. The first line on the club is then aligned with the target equatorial marking, while the second line on the club is positioned parallel to the second equatorial marking on the ball. While the Yamamoto ball-and-club arrangement increases the ability of a golfer to properly aim a putt, it addresses only some of the alignment concerns in the execution of a putt. Moreover, the right angle equatorial markings on the ball may not be considered aesthetically acceptable to many golfers. More subtle markings would be preferred.

An object of the invention is to provide a golf ball and golfing method that aid a user to accurately align a golf ball to an intended path of travel, align a golfer relative to the aligned ball, and align a golf club relative to the aligned golfer and ball.

SUMMARY OF THE INVENTION

The above object has been met by a golf ball and a method of making and using the golf ball to include a ball-travel indicator, a ball-to-ground indicator, a putter-alignment indicator, and a foot-to-ball indicator. The indicators provide means for providing precise relative alignment among an intended path of ball travel, the golf ball, the putter and the user.

In the preferred embodiment, the ball-travel indicator is an arrow that is coplanar with a first reference plane that bisects the spherical golf ball. In use, the golfer aligns the arrow with the desired direction of travel for the initial portion of ball travel. The arrow configuration is not critical, but is preferred since it distinguishes the ball-travel indicator from the other indicators and because it provides the desired impression of aim.

The ball-to-ground indicator is perpendicular to the ball-travel indicator. In use, the golf ball is to be rested on a green such that the ball-to-ground indicator is parallel to the ground and is behind the ball-travel indicator relative to the desired path. Thus, the ball-to-ground indicator is used to ensure that the ball-travel indicator is properly aimed. The ball-to-ground indicator may be a single line or may be markings on opposed sides of the first reference plane, but other embodiments are contemplated.

The foot-to-ball indicator is parallel to the ball-travel indicator. After the golf ball has been properly aligned with respect to the intended path of travel and the ground, the foot-to-ball indicator is visible to the golfer when positioned adjacent to the ball and provides an aid for aligning the golfer's feet perpendicular to the intended path. The foot-to-ball indicator is closer to the golfer's feet than the ball-travel indicator.

Finally, the putter-alignment indicator is perpendicular to the ball-travel indicator and is in spaced relation to the ball-to-ground indicator. In the preferred embodiment, the putter-alignment indicator and the ball-to-ground indicator are on opposite sides of a second reference plane that bisects the spherical golf ball and that is perpendicular to the first reference plane. In use, the putter-alignment indicator is on the upper hemisphere defined by the second reference plane and the ball-to-ground indicator is on the lower hemisphere. Thus, of the two parallel indicators, the properly positioned golfer is able to see only the putter-alignment indicator. The golfer positions the putter parallel to the putter-alignment indicator. This indicator is toward the rear of the ball relative to the intended path and is used by the golfer to ensure that the striking face of the golf club is perpendicular to the intended path.

While the golf ball having the various indicators has been described with reference to executing a putt, the ball and method may also be used at other times in which rules allow a player to determine the position of a ball relative to a desired path of ball travel. For example, the method may be used to aid a player in achieving proper body and club position for driving the ball from a golf tee.

The various indicators may be formed on the golf ball using a stencil. For example, the player may use an indelible ink marker to stencil the indicators onto a conventional store-bought golf ball. Stenciling of the indicators increases the cost effectiveness of the ball and method.

BEST MODE FOR CARRYING OUT THE INVENTION

Figure 1:
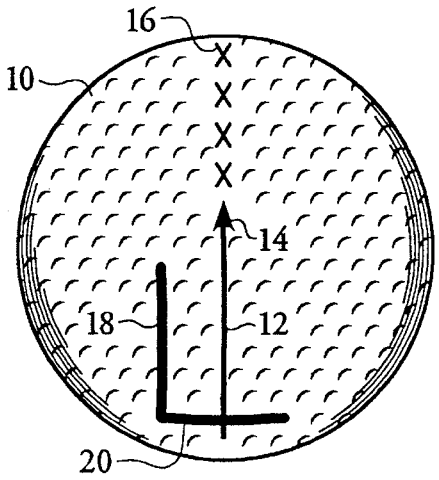
FIG. 1 is a top view of a first embodiment of a golf ball having indicators in accordance with the invention.

With reference to FIG. 1, a golf ball 10 is shown as having a ball-travel indicator 12. The indicator 12 does not travel around the entirety of the ball, but instead has an arrow 14 at an end that is defined as a forward end relative to a path that the ball is intended to travel.

In the embodiment of FIG. 1, the ball-travel indicator is aligned with a reference plane that bisects the spherical golf ball 10. This is clearly the preferred embodiment, but is not critical. In this embodiment, the indicator 12 will extend across the apex of the ball when it is properly situated on a green or on a golf tee.

Directly in front of the ball-travel indicator is a series 16 of X's that represent print on the ball. The print may be a trademark, for example. The print is aligned with the arrow to act as an extension that aids in "aiming" the ball without detracting from the aesthetics of the golf ball.

The golf ball 10 also includes a foot-to-ball indicator 18 that is parallel to the ball-travel indicator 12. When the golf ball is properly positioned relative to an intended path, the foot-to-ball indicator 18 is closer to the player than the ball-travel indicator 12. Consequently, the indicator 18 provides a better reference for aligning the player's body relative to the intended path. In the preferred embodiment, the foot-to-ball indicator 18 has a thickness greater than that of the ball-travel indicator 12. The thicknesses of the indicators 12 and 18 are selected to promote the respective objectives of the indicators. The thicker foot-to-ball indicator achieves the desired visibility for a golfer standing over the golf ball 10.

Figure 2:
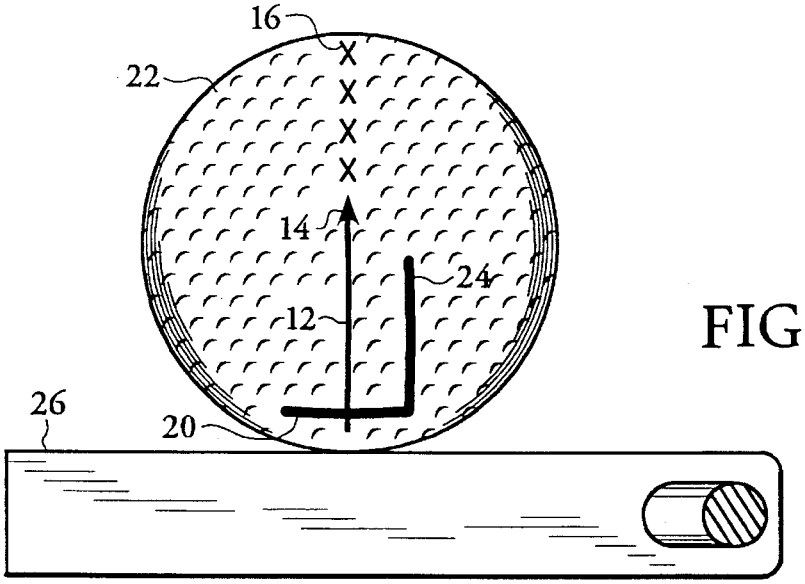
FIG. 2 is a top view of a second embodiment of a golf ball having indicators in accordance with the invention.

Also shown in FIG. 1 is a putter-alignment indicator 20. This indicator 20 is perpendicular to the ball-travel indicator 12 to provide a reference for positioning a putter in the proper alignment for stroking the golf ball 10 in the desired direction. Referring now to FIG. 2, a second embodiment of a golf ball 22 having the appropriate indicators is illustrated. In this embodiment, the foot-to-ball indicator 24 is on the opposite side of the ball-travel indicator 12. Since the markings on the ball 22 are identical to those of FIG. 1, other than the position of the foot-to-ball indicator 24, the reference numerals are repeated in FIG. 2. The golf ball 22 is designed for use by a left-handed golfer. The position of the foot-to-ball indicator 24 will therefore be closer to the golfer's feet than would be the case if the indicator 24 were on the opposite side of the ball-travel indicator 12.

A putter 26 for a left-handed golfer is shown as being parallel to the putter-alignment indicator 20. In this alignment, the golf ball 22 will travel in the direction of the arrow 14 upon impact between the putter and the ball. The putter-alignment indicator promotes accurate judgement of the putter face as being perpendicular to the intended path of ball travel.

Figure 3:
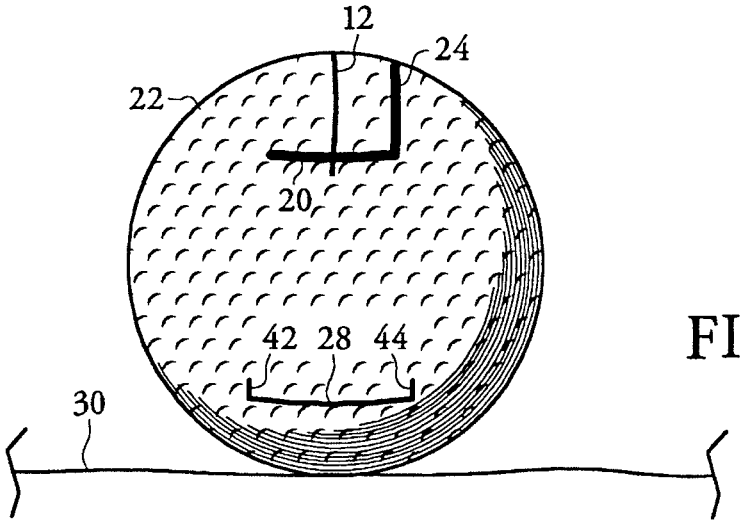
FIG. 3 is a rear view of the golf ball of FIG. 1 when the ball is in use and is properly positioned.

Referring now to FIG. 3, a rearward view of the golf ball 22 reveals a fourth indicator 28. The fourth indicator is a ball-to-ground indicator 28 that promotes proper placement of the ball on a green 30. As previously noted, the preferred embodiment of the invention has the ball-travel indicator positioned to be at the apex of the ball when the ball is rested on the green 30 with the ball-travel indicator aimed in the desired direction of ball travel. The ball-to-ground indicator 28 may be used as a reference to determine when the ball is optimally positioned, since the indicator 28 will be parallel to the surface of the green when the ball-travel indicator 12 is at the apex.

In operation, when a player reaches a green 30, the rules of golf allow the player to mark the position of the ball 22, lift the ball, and reposition it in any manner the player wishes. To properly reposition the ball 22 of FIGS. 2 and 3, the first step is to calculate the initial direction and speed of the ball for sinking the putt. That is, the green must be "read." The next step is to execute the putt. The indicators 12, 20, 24 and 28 reduce the likelihood that the player's mechanics will cause a putt to be missed after the green has been accurately read.

The ball-travel indicator is aimed in the desired direction of initial travel. On a flat green 30, the arrow 14 will therefore be directed at the hole. On the other hand, if the green includes a sloped region between the ball and the hole, the initial direction will be calculated to compensate for the curvature caused by the sloped region.

The golfer may then use the ball-to-ground indicator 28 to ensure that the ball-travel indicator 12 is positioned properly relative to the surface of the green 30 on which the ball 22 immediately rests. This may require some rotation of the ball until the ball-to-ground indicator 28 is parallel to the surface of the green. As shown in FIG. 3, the ball-to-ground indicator is on the lower hemisphere of the golf ball, thereby positioning the indicator to facilitate the placement of the indicator 28 in parallel relation with the green 30. On the other hand, the putter-alignment indicator 20 is on the upper hemisphere of the golf ball 22, so that a player is able to view the ball when the golfer's head is directly over the ball during execution of the putt. The distance between the parallel indicators 20 and 28 is somewhat exaggerated in FIG. 3 in order to better illustrate the differences in purposes of the two indicators 20 and 28. While the preferred embodiment is one in which the indicators are on opposite sides of a reference plane that bisects the upper and lower hemispheres, this is not critical.

After the ball-direction indicator 12 and the ball-to-ground indicator 28 have been used to precisely position the golf ball 22, the foot-to-ball indicator 24 is utilized. It is generally accepted that a golfer's feet should be directed perpendicular to the direction of ball travel. The foot-to-ball indicator 24 provides a highly visible reference for determining the proper position of the feet relative to ball travel.

In a final alignment step, the putter-alignment indicator 20 is used as a reference for aligning the putter 26 with the desired direction of ball travel. The ball-travel indicator 12 includes a portion that extends rearwardly from the putter-alignment indicator 20 to aid the golfer in centering the putter face 26 and providing the golfer with a visual aid as to the optimal spot to strike the ball. As shown in FIG. 2, the indicator 20 is at the rear of the golf ball 22 as viewed by the golfer. Only a short distance separates the striking face of the putter 26 from the indicator 20. This facilitates proper putter alignment. The putter 26 is moved rearwardly and then returned to the position of FIG. 2 so as to putt the ball 22 in the direction indicated by arrow 14.

While FIGS. 1–3 illustrate the preferred embodiments of the invention, the indicators 12, 18, 20, 24 and 28 may have other configurations. For example, the ball-to-ground indicator 28 may be separate markings on opposed sides of the bisecting reference plane aligned with the ball-travel indicator 12. That is, the ball-to-ground indicator 28 may be separate markings on the left and right sides of the ball 22 as shown in FIG. 3. As another example, the arrow 14 need not be located at the forward end of the ball-travel indicator 12. In comparing FIGS. 1 and 2, the foot-to-ball indicators 18 and 24 are on opposed sides of the ball-travel indicator 12. Optionally, a single ball may have both of the indicators 18 and 20, so that the ball will work equally well for left-handed and right-handed golfers. However, this detracts somewhat from the discreetness of the indicators shown in FIGS. 1–3.

Figure 4:
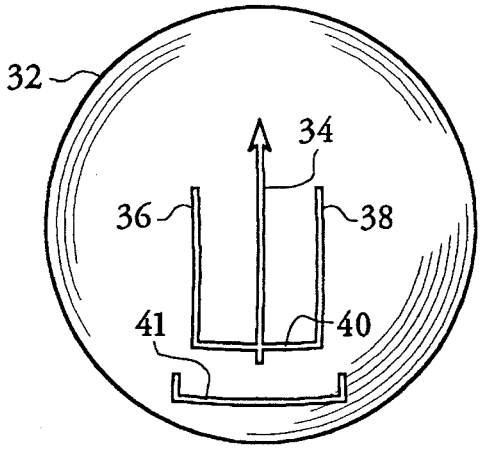
FIG. 4 is a top view of a stencil for forming the indicators of FIGS. 1 and 2.

Referring now to FIG. 4, the indicators are preferably stenciled onto the golf ball. In the preferred embodiment, the stencil is hemispherical. Alternatively, a user may merely purchase a stencil 32 that can be partially wrapped around any conventional golf ball for marking the ball with an indelible ink pen or a paint brush.

The stencil 32 is formed to include an arrow 34. Also formed through the stencil 32 are parallel lines 36 and 38 on opposite sides of the arrow 34. Dependent upon whether the player is left-handed or right-handed, the appropriate line is selected for forming a foot-to-ball indicator 18 and 24 on a golf ball 10 and 22. Optionally, both lines 36 and 38 may be used to form opposed indicators on the golf ball. A line 40 that is perpendicular to the lines 36 and 38 and to the arrow 34 is formed in the stencil 32 to provide the putter-alignment indicator 20. While all of the openings through the stencil of FIG. 4 are shown as having an equal thickness, preferably, the lines 36, 38 and 40 are thicker than the arrow 34, for reasons noted above. Also shown in FIG. 4 is a stencil opening 41 for forming a ball-to-ground indicator. Alternatively a separate stencil may be used to form the ball-to-ground indicator 28 on the lower hemisphere of the golf ball. To facilitate judgement of centering the ball-travel indicator 12, projections 42 and 44 may be added, as shown in FIG. 3.

Figure 5:
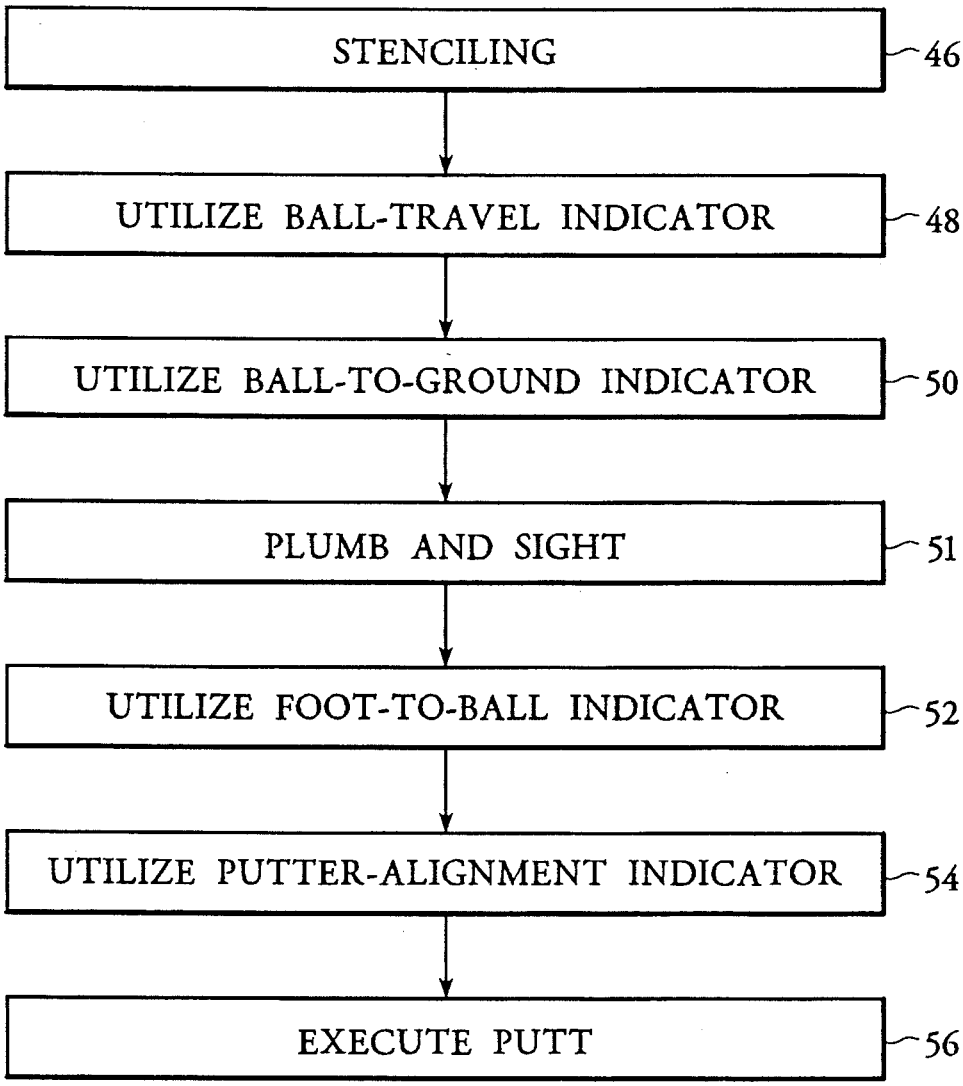
FIG. 5 is a diagram of the steps for using the golf ball of FIG. 2 in accordance with the invention.

Referring now to FIG. 5, the method steps for using the invention are shown. In step 46, the indicators are stenciled onto a golf ball. Then, when a golfer is able to position a ball during play, the ball-travel indicator 12 of FIG. 1 is utilized, shown at step 48. The printing represented by series 16 provides an extension for facilitating proper aim of the arrow 14 at the intended path of ball travel.

In step 50, the ball-to-ground indicator 28 is utilized to determine whether some rotation of the ball is necessary to precisely position the ball-travel indicator 12 relative to the apex of the golf ball. Typically, the rotation will be about an axis that is parallel to the direction of ball travel. In step 51, a putter may be used as a "plumb" to mark a desired path, whereafter the indicator 12 and the printing 16 may be sighted using the "plumb."

The golfer is then aligned relative to the precisely positioned golf ball. In step 52, the foot-to-ball indicator 18 or 24 is employed as a reference for positioning the golfer's feet perpendicular to the intended path of travel. In the next step 54, the putter 26 is properly positioned by use of the putter-alignment indicator 20. Optionally, steps 52 and 54 may be reversed. Finally, the putt is executed at step 56.

I claim:

1. A golf ball having a proper position on a green which promotes accurate putting, said golf ball comprising:

a spherical body having an exterior surface and further having a top hemisphere and a bottom hemisphere;

a ball-travel indicator on said exterior surface, at least a first portion of said ball-travel indicator being aligned with a first reference plane bisecting said spherical body;

a ball-to-ground indicator extending on said exterior surface in a direction generally perpendicular to said first portion of said ball-travel indicator;

a putter-alignment indicator extending on said exterior surface in spaced relation to said ball-to-ground indicator and in a direction generally perpendicular to said first portion of said ball-travel indicator; and a foot-to-ball indicator extending on said exterior surface in spaced parallel relation to said ball-travel indicator;

said top and bottom hemispheres being defined a second reference plane bisecting said spherical body and being perpendicular to said first reference plane;

said ball-travel and putter-alignment indicators being positioned in said top hemisphere, a second portion of said ball-travel indicator being at the apex of said golf ball when said golf ball is in said proper position;

said ball-to-ground indicator being positioned in said bottom hemisphere and having a separation from said putter-alignment indicator so that said ball-to-round indicator is proximate to a surface of said green when said golf ball is in said proper position.

2. The golf ball of claim 1 wherein said ball-travel indicator has an arrow configuration and indicates a direction away from said putter-alignment indicator.

3. The golf ball of claim 2 further comprising print formed on said exterior surface, said print and said ball-travel indicator being coplanar with said first reference plane.

4. The golf ball of claim 1 wherein said putter-alignment indicator and said foot-to-ball indicator connect to form an L shape.

5. The golf ball of claim 1 wherein said putter-alignment indicator and said foot-to-ball indicator connect to form a reversed L shape.

6. The golf ball of claim 1 further comprising lines extending from said ball-to-ground indicator at an angle to said ball-to-ground indicator.

* * * * *